United States Patent [19]

Schneider et al.

[11] Patent Number: 5,046,630

[45] Date of Patent: Sep. 10, 1991

[54] CAP AND RECEPTACLE WITH CONSTANT ORIENTATION

[75] Inventors: Bernard Schneider; René Hoslet, both of Sainte Menehould, France

[73] Assignee: Cebal, Clichy, France

[21] Appl. No.: 557,793

[22] Filed: Jul. 26, 1990

[30] Foreign Application Priority Data

Jul. 28, 1989 [FR] France ..... 89 10455

[51] Int. Cl.[5] ..... B65D 45/34

[52] U.S. Cl. ..... 215/321; 215/320; 53/76

[58] Field of Search ..... 215/211, 216, 317, 320, 215/321, 354

[56] References Cited

U.S. PATENT DOCUMENTS 3,877,598 4/1975 Hazard ..... 215/306 X 4,134,513 1/1979 Mumford ..... 215/216

4,257,526 3/1981 Weits et al. ..... 215/321 X

*Primary Examiner*—Stephen Marcus

*Assistant Examiner*—Nova Stucker

*Attorney, Agent, or Firm*—Dennison, Meserole, Pollack & Scheiner

[57] ABSTRACT

The invention relates to a unit made up of a cap and a receptacle with a neck made of plastics, the cap includes a base made of plastics, the base including a sealing member inside the neck which can be fixed on the neck simply by pushing and snapping it on. The base and neck, by longitudinal insertion, cooperate to prevent relative rotation. When the base is pushed onto the neck, insertion with a full cross-section is initiated, then forced insertion of the sealing member in the neck is initiated, and then the snapping on action is initiated. The cap of the invention is used to provide decorated tubes, with the cap oriented in a constant and definitive manner relative to the tubes.

11 Claims, 6 Drawing Sheets

CAP AND RECEPTACLE WITH CONSTANT ORIENTATION

The invention relates to a cap made of two parts which are typically hinged together The first part is a base or stub which is fixed imperviously to the neck of a receptacle. The second part seals the orifice extending through the first part in the closed position and can be opened e.g. by rotation or pivoting relative to the first part.

Plastics caps of this type are known, with the base or stub fixed on the plastics neck of a tube typically with a snap-on action; the base comprises a means for sealing inside the neck, e.g. a ring which can be forced into the neck. The position of such a cap relative to the receptacle on which it is fixed may be changed deliberately or accidentally. This of often undesirable in the case of a mass produced receptacle of a circular, non-cylindrical shape and/or with a decorated skirt.

Applicants have endeavoured to perfect a receptacle with an opening cap which does not have these disadvantages.

EXPLANATION OF INVENTION

The object of the invention is a unit made up of a cap and a receptacle with a neck made of plastics; the cap in known manner comprises a base or stub made of plastics and an opening part which can seal the base; the base has a means for sealing inside the neck and can be fixed on the neck simply by pushing and snapping in.

The novel features are that:

a) the base and neck comprise means for relative immobilisation in rotation by longitudinal insertion;

b) the mating longitudinal insertion means and the mating snapping on means on the base and neck respectively, and the sealing means on the base, are arranged so that the following sequence of events is obtained when the base is pushed onto the neck:
   insertion with a full cross-section is initiated;
   then forced insertion of the sealing means in the neck is initiated;
   then the snapping on action is initiated.

Generally speaking, the orientation of the cap base relative to the receptacle or tube can be fixed definitively through longitudinal insertion of blades carried by the cap base in the outer layers of the neck, the blades at first penetrating gradually then being forced in. Such insertion requires particular force when the cap is being pushed onto the neck, and refusal of the cap to be inserted has been experienced with a ram for pushing the cap onto the neck, as used for caps which open or "service" caps not provided with such longitudinal insertion means.

Applicants have observed that the force corresponding to this insertion is at a maximum when the insertion reaches the full or maximum cross-section stage. They have also noted that if the maximum insertion force is reached simultaneously with the forced insertion of the sealing ring into the neck, this gives an inserting force which is unacceptable for such an installation. The insertion of the sealing ring is consequently timed to follow the beginning of insertion over a full cross-section, and care must similarly be taken to prevent it from coinciding with the maximum snap-on force, at the beginning of the snapping-on action. These observations are important, since the height of the cap base or stub and the height of the corresponding part of the neck are limited, and there is not much scope for positioning the fixing and sealing means.

The longitudinal insertion means carried by the cap base preferably comprise radial cutting fins with a tapering edge 0.1 to 0.3 mm thick; the neck of the receptacle may have an anti-rotation locking portion with an external diameter larger than the internal diameter between tapering edges of said cap base; and the base may be made of a plastics material harder than the plastics material of the neck. The radial fins are typically carried by the inside of an axial ring inside the cap base, and the snap-on means of the cap is also carried by that ring, below said fins.

The use of longitudinal radial cutting fins, arranged inside a plastics ring, is known from Patent EP-B-0192011, as a means for fitting into a tear-off cap and entraining it in rotation. Such fins are used here as an anti-rotation means for the cap base relative to the neck.

In the case of the cutting fins, the initiation of cutting is preferably made gradual by chamfering the top of the extra thick portion to be cut on the neck, and also by gradually widening the bottom of the fins. The initiation of cutting over a full cross-section requires a cutting force produced by maximum driving in of the cap base, whereas continuation of the cutting action is easier. The excellent relative immobilisation obtained by the fins, with the cut plastics material being applied with a locking action to each portion of fin inserted, is known from the above document. The respective choices of plastics for the cap base and neck are known from that document.

Particularly in the case of the radial cutting fins, it has been found that the following two practical rules must be complied with in order to facilitate the pressure of the cap base onto the neck, i.e. using the normal equipment:

the difference in level (D1) of the cap base, between the end of the widened part of the bottom of its cutting fins and the beginning of the forced insertion portion of its sealing means must be greater than the difference in level (d1) of the neck, between the top of its orifice and the beginning of its anti-rotation locking portion;

the difference in level (D2) of said cap base, between the minimum diameter of its snap-on means and the beginning of the forced insertion portion of its sealing means must be less than the difference in level (d2) of the neck, between the top of its orifice and the maximum diameter of its snap-on means corresponding to the snap-on means of the cap base.

The differences in level (D1) and (D2) of the cap base and (d1) and (d2) of the neck are shown in FIGS. 1 and 4.

The cap base must be inserted in the neck of the receptacle axially and with correct centering, both for the sealing means inside the neck and the snap-on means; the means for preventing rotation by longitudinal insertion, particularly the cutting means, do not generally have a centering function. In the case of manual insertion and even more in the case of mechanical insertion in mass production, it is desirable to provide for initiation of the insertion of the cap base, by having a cylindrical guiding portion at the top of the neck, with an external diameter less than 0.5 mm and typically from 0.1 to 0.4 mm less than the internal diameter between the insertion means, particularly between tapering cutting edges on the cap base. There may be a first positioning of the cap base on the guiding portion, typically from 2 to 4 mm high, then a thrust to terminate insertion. The reference events already described, corresponding to peaks of insertion force, are facilitated by axial alignment and centering carried out by the guiding portion. The snap-on means, located below the anti-rotation means, are typically a spring ring and an annular throat with mating profiles, selected to facilitate engagement and retention of the cap base. In axial section those profiles preferably have an upper or entry surface inclined at 15° to 35° to the axis and a lower or abutment surface inclined at 40° to 60° to the axis.

It has been found preferable in this application to have a total angle of 10° to 15° to the axis, in perpendicular section, for the tapering radial fins which cut the neck. The preferred arrangement for the neck comprises a thickened anti-rotation portion with its upper end chamfered at 10° to 30° relative to a perpendicular plane or "horizontal" plane, with a guiding portion above it.

The invention also concerns the use of the opening cap on a receptacle, making it possible to obtain a fixed position of the cap stub or base on the neck, with a selected orientation relative to the receptacle, according to the background design provided or the particular shape of the receptacle. This use will be described in the examples.

EXAMPLES

Figure 1:
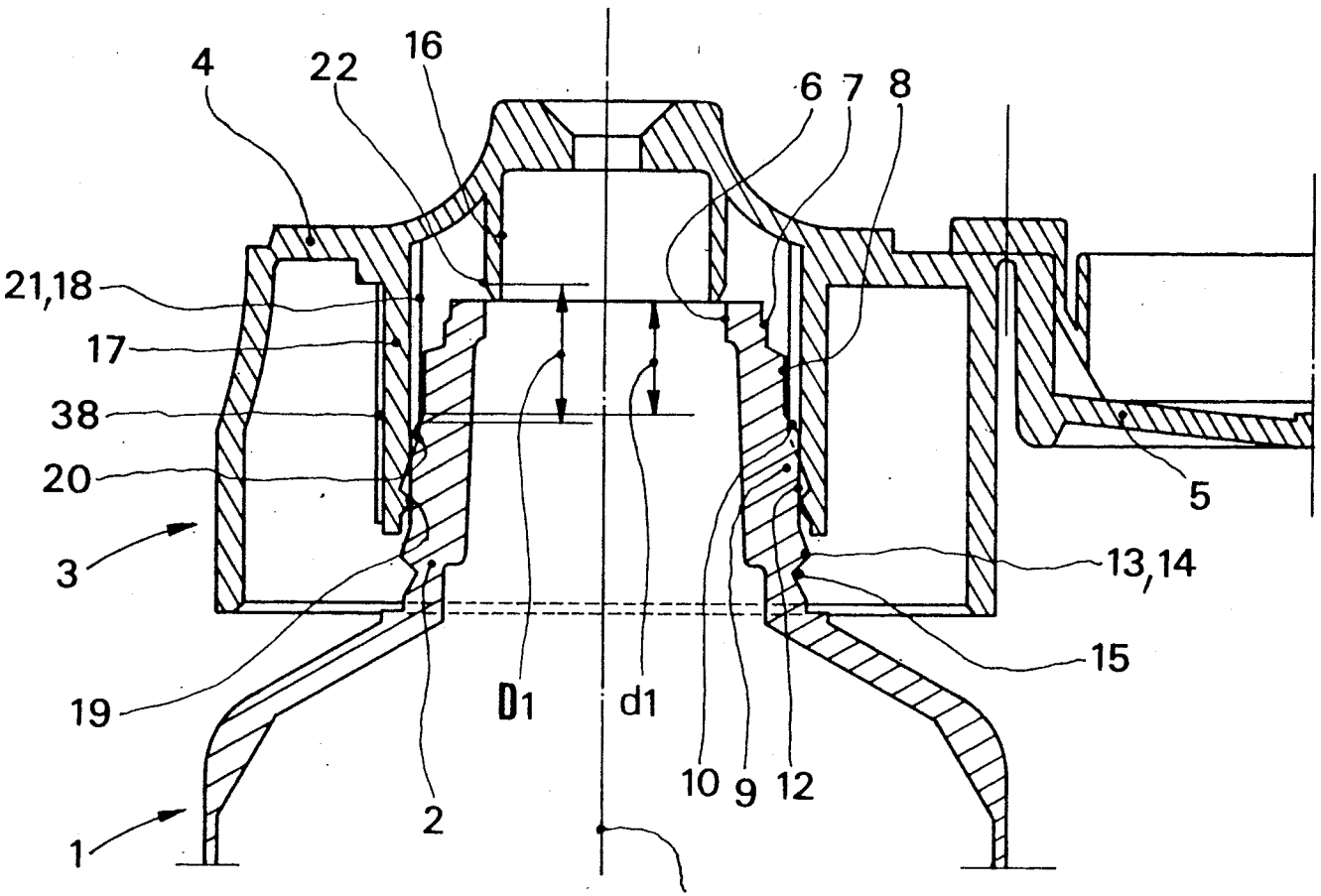
FIG. 1 shows a unit according to the invention, in the cutting phase, in axial section.

Referring to FIG. 1, this shows a tube low density polythene, with a polypropylene cap 3 on top of it. The cap 3 comprises a base or stub 4 and a cover 5 connected to the base. The cover is shown in the open position here, although in reality it would be closed when the cap 3 is pushed onto the neck 2. The top of the neck 2 has a cylindrical orifice 6 which is 11 mm in diameter and 1.5 mm high. The outside of the neck 2 comprises, in a downward direction: a free engagement portion 7 which is 2 mm high; then a cylindrical guiding portion 8 which is 16 mm in diameter and 2.5 mm high; then an anti-rotation locking portion 9, which begins with a frustoconical chamfer 10 at 60° to the axis of symmetry 11, and which continues with a cylindrical portion 12 with a diameter of 17 mm and a height of 4 mm; and finally a circular snap-on protrusion 13 with a maximum diameter of 18.5 mm, the line 14 corresponding to this diameter being 11 mm (=d2) below the upper end of the neck 2, the protrusion 13 being followed by a snap-on throat 15.

Inside the base 4 of the cap there is a central sealing ring 16 with an external diameter of 11.3 mm and an internal diameter of 9.1 mm, which is forced into the orifice 6 of the neck 2. In addition to the ring 16 there is an intermediate ring 17 with an internal diameter of 18.2 mm. The inside of the ring 17 carries four tapered radial fins 18 spaced at 90°, and lower down a snap-on rib 19. The profile of the rib 19 in axial section corresponds to that of the throat 15 of the neck 2, with an upper surface inclined at 30° to the axis and a lower surface inclined at 50°.

The cutting fins 18 have an end 20 which increases in width over a height of 2 mm, then an axial edge 21 which is 0.2 mm thick, with a total angle of 13° to the axis 11 (in perpendicular section); the width of each fin 18 is then 1 mm and the internal diameter between fins 16.2 mm. The difference in level between the bottom of the axial edges 21 and the bottom 22 of the 11.3 mm diameter of the central ring 16 is 6 mm (=D1), while the difference in level D2 between the minimum diameter of the rib 19 and the same bottom of the full cross-section of the central ring 16 is 9 mm.

As shown in FIG. 1, the bottom 4 of the cap 3 has been pushed onto the neck 2 with good centering—due to the sliding of the edges 20 of the fins 18 with a clearance of 0.2 mm in diameter around the guiding portion 8—then, with the gradual widening of its fins 18, has started cutting into the top of the locking portion 9 of the neck 2. The engagement of the fins has been facilitated by the chamfer 10, and the maximum cutting force is being reached or is on the point of being reached. During this time the sealing ring 16 is not yet engaged in the orifice 6 of the neck, and when it is engaged therein by force the cutting by the fins will be sufficiently advanced to make the total inserting force acceptable.

This favourable situation is indicated by the condition "(D1) larger than (d1)": D1 has been seen to be equal to 6 mm, while (d1), the difference in level between the top of the neck 2 and the top of the frustoconical chamfer 10 at the top of its locking portion, is 4.5 mm.

Figure 2:
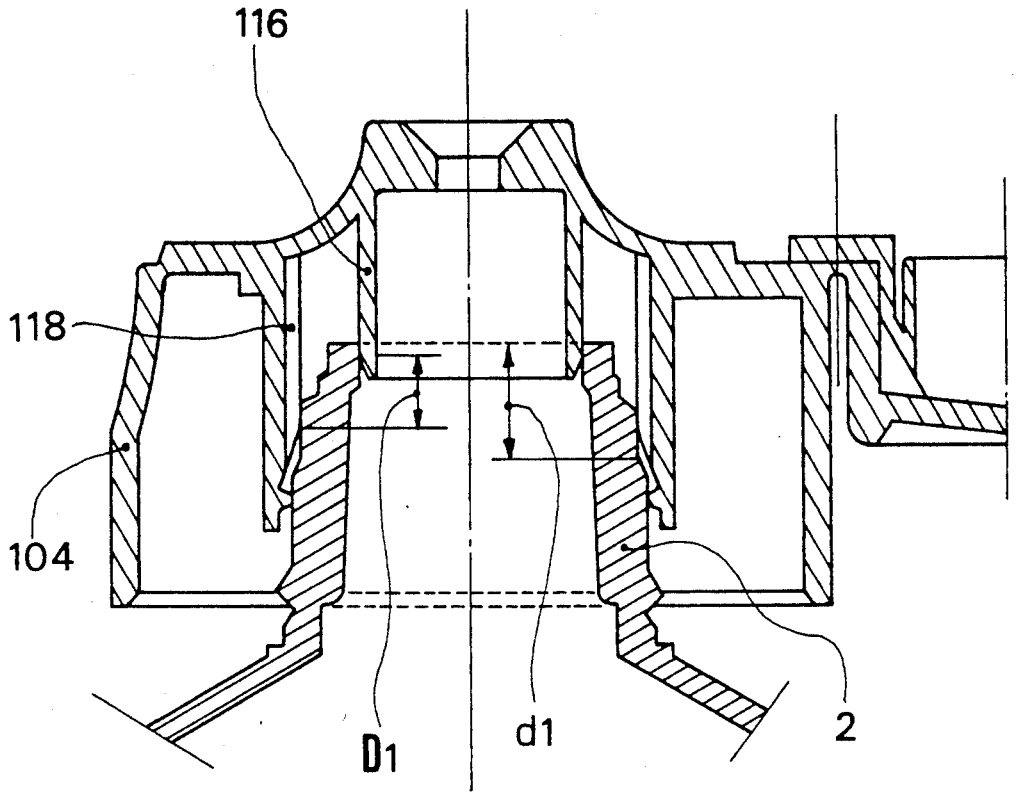
FIG. 2 shows a comparative, faulty unit in axial section.
Figure 3:
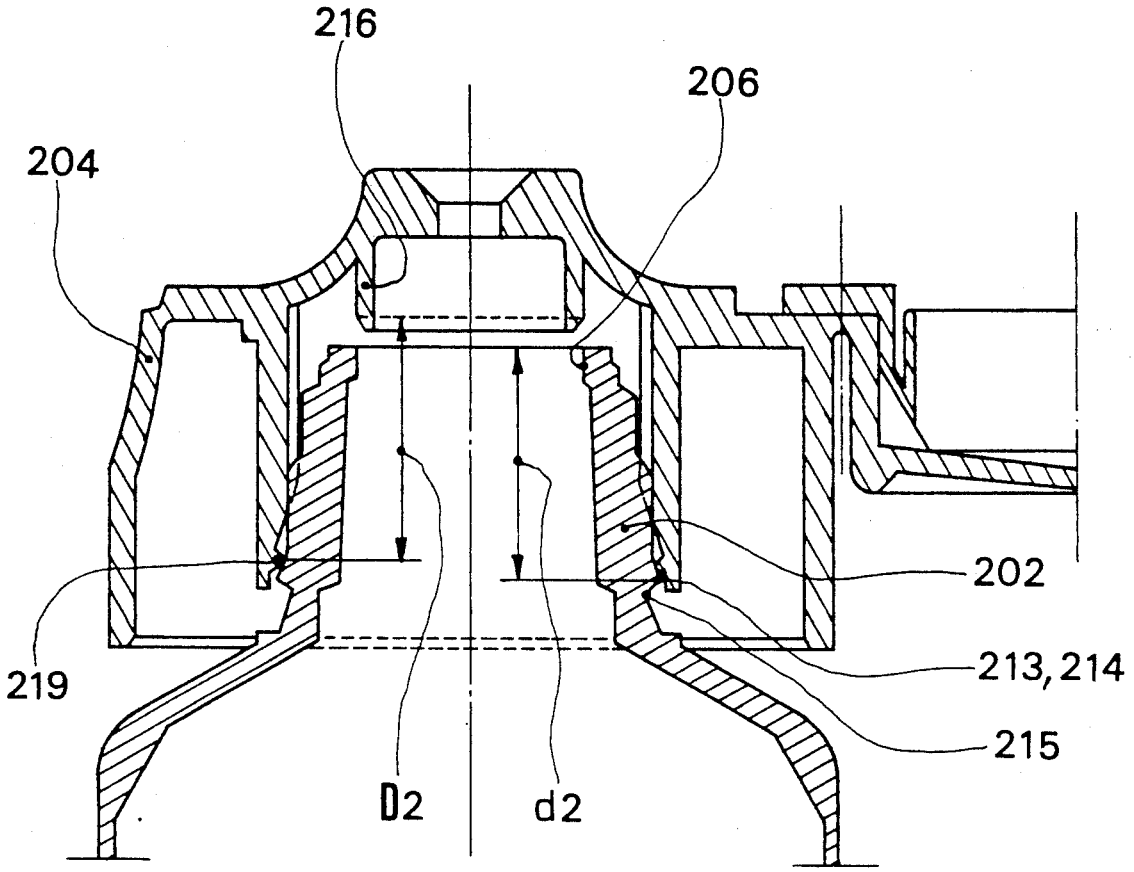
FIG. 3 shows a second faulty unit in axial section.

FIGS. 2 and 3 show two unfavourable situations outside the scope of the invention, as a comparison.

In FIG. 2 the central ring 116 of the cap base 104 is longer, so that it goes into the neck 2 before the fins 18 start cutting. The force required to start cutting plus the force to continue the forced insertion of the ring 116 into the orifice 6 give an abnormally high total force, and make the bottle refuse mechanised stoppering. D1=3 mm whereas d1 is still 4.5 mm. In FIG. 3 the cap base 204 has a difference in level D2 of 9.3 mm between the bottom of the full cross-section of its central sealing ring 216 and the minimum diameter of its snap-on rib 219. The neck 202 has a difference in level d2 of 9 mm between its upper end and the line 214 of maximum diameter of its snap-on protrusion 213. In this situation the rib 219 can be snapped into the throat 215 of the neck 202 without any trouble, but the sealing ring 216 is then hardly engaged, a situation which is unacceptable. If D2 were equal to d2, the friction of the minimum diameter of the rib 219 against the maximum protrusion 214 above the snap-on throat 215 of the neck 212 would coincide with the beginning of the forced engagement of the ring 216 in the orifice 206 of the neck; under normal conditions this would make the stopper refuse any further insertion.

Owing to the fact that the diameter of the protrusion 214 often increases gradually, and on the basis of the above analysis, it is preferable in practice for (D2) to be at least 1 mm smaller than (d2).

Figure 4:
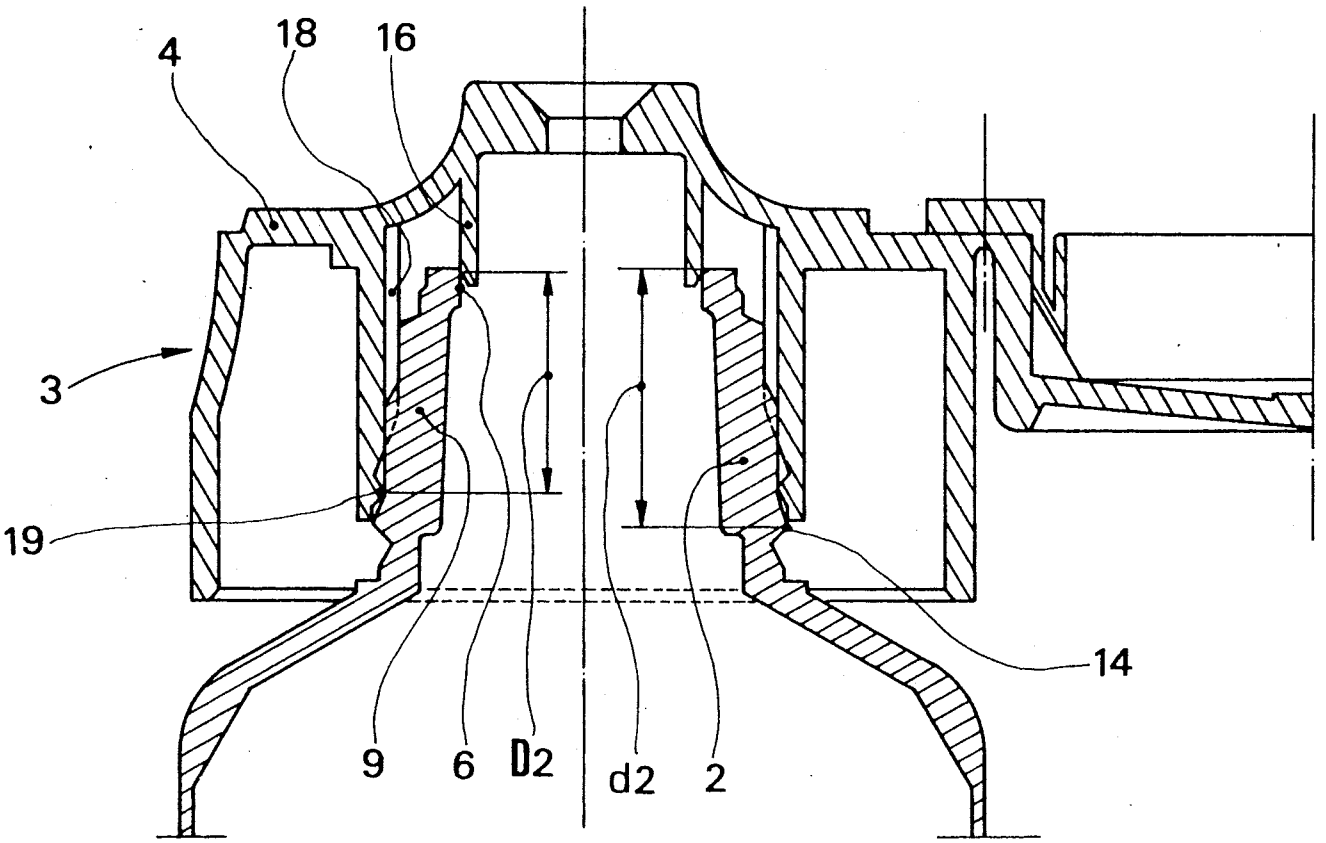
FIGS. 4 and 5 show the FIG. 1 unit in axial section, respectively at the beginning of the forced insertion of the sealing ring into the neck and at the beginning of the snapping-on action.
Figure 5:
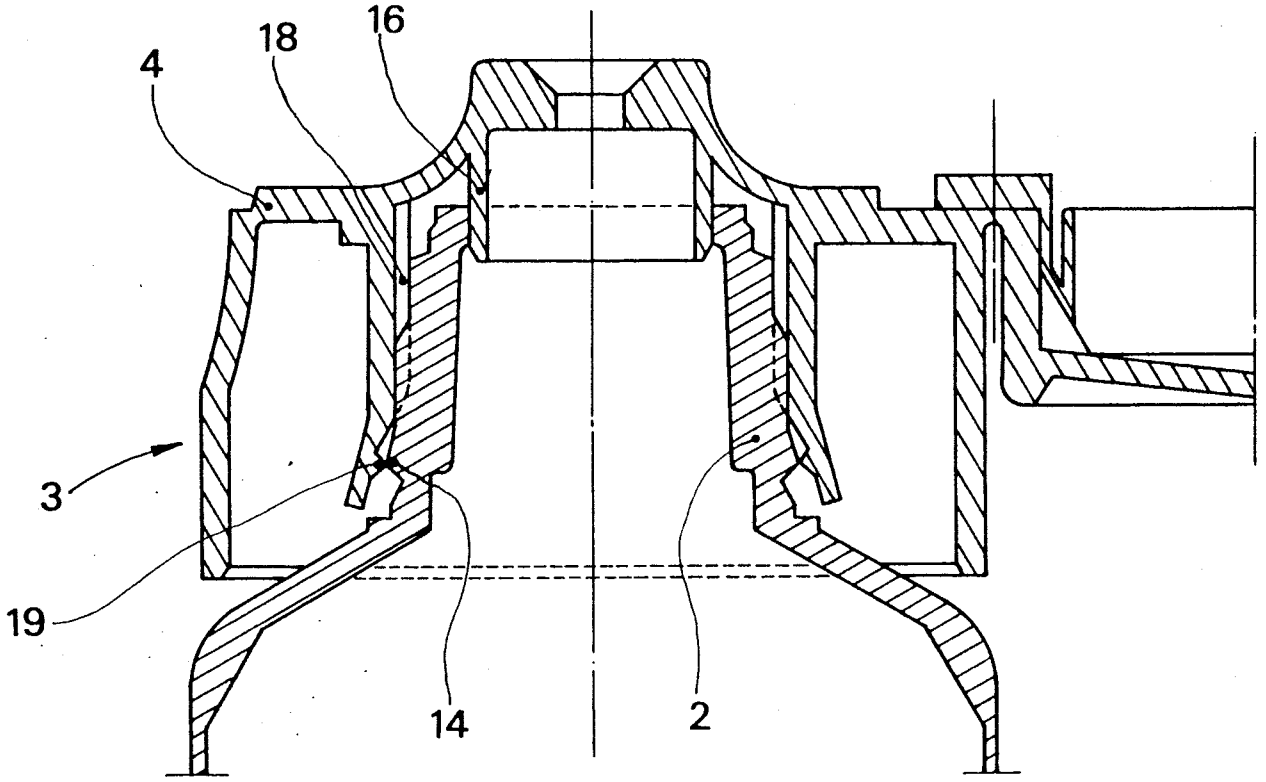

FIGS. 4 and 5 show the unit according to the invention from FIG. 1, in the subsequent stages of the insertion of the cap base 4, which are considered critical when the structures no longer comply with the conditions of the invention.

It will be seen from FIG. 4 that the cutting of the locking portion 9 of the neck 2 by the cutting fins 18 is well advanced when the forced insertion of the sealing ring 16 into the orifice 6 of the neck commences, and that there is not yet any inserting force preparing for the snap-on effect. D2=9 mm and d2=11 mm. The order of precedence of the major forcing and frictional actions is respected.

In FIG. 5 the bringing of the rib 19 (internal diameter at rest 17.2 mm) and into registry with the enlarged portion 14 (diameter 18.5 mm) of the snap-on protrusion of the neck 2 coincides with an insertion force which is usually stronger The sealing ring 16 is well engaged in the orifice 6, and there is now only a sliding movement of the cutting fins 18 in the cuts or incisions already produced in the neck 2. Tests carried out on a series of products show that the pushing of the cap base 4 onto the neck 2 could be completed without difficulty in such a situation.

EXAMPLE OF USE

Figure 6:
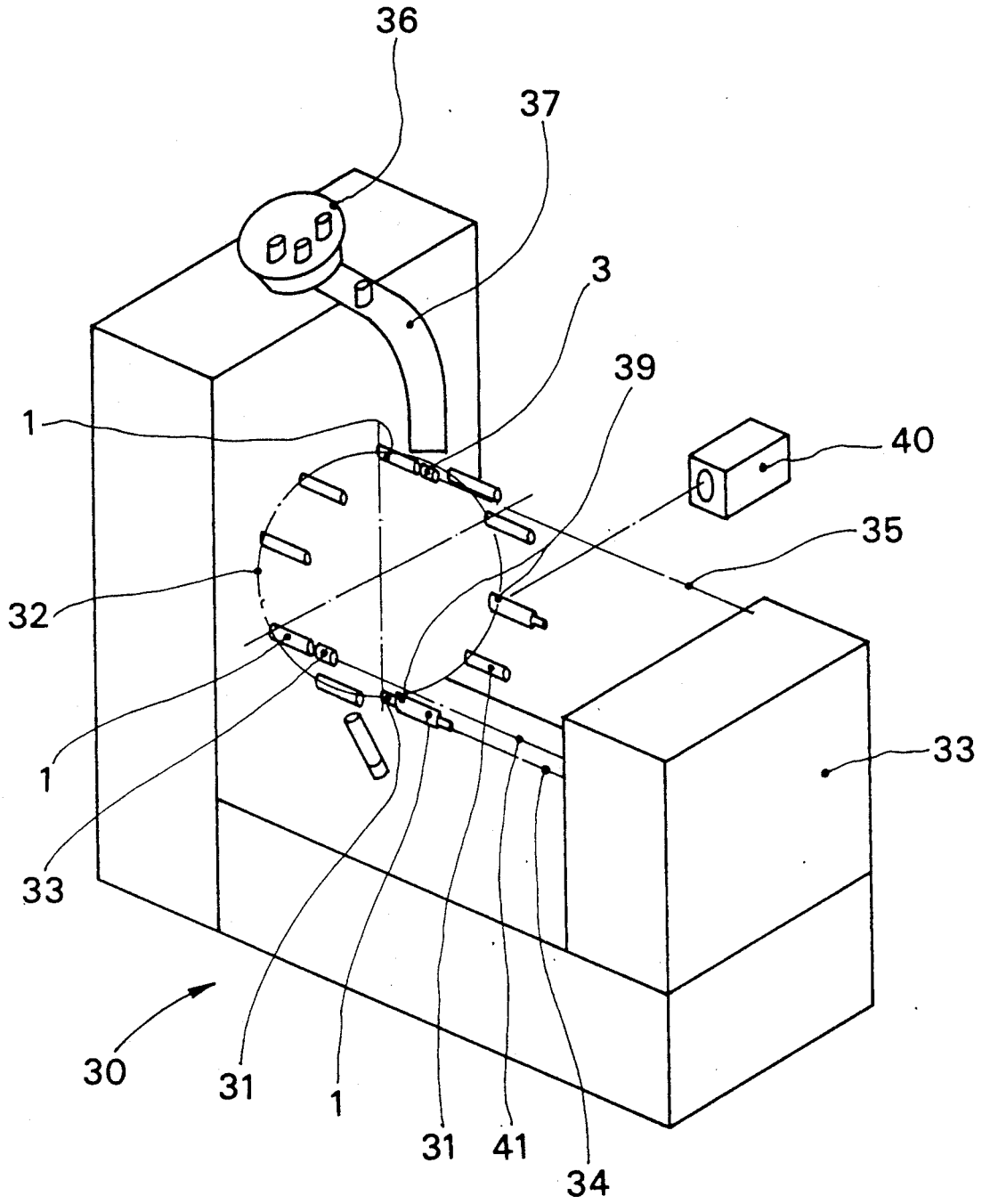
FIG. 6 shows an arrangement for positioning caps according to the invention on tubes, in isometric projection.

FIG. 6 shows the use of units such as that in FIG. 1 in a stoppering installation 30. The tubes 1 are each placed on a horizontal chuck such as 31, which is mounted on a revolving turret 32 and which can be entrained in rotation on itself. The tubes 1 thus mounted, neck forwards, are placed in successive positions which will be referred to as the corresponding hours on a clock face. The block 33 brings together various means, particularly a loading ram (axis 34) and two rams for inserting the caps 3, with axes 35 and 41.

Above the turret 32 and to the rear there is a vibratory hopper feeder 36 through which the caps are supplied. Each cap 3 is extracted from it then conveyed along a guiding path 37. The path is at first horizontal or slightly inclined, then descends to bring the cap, top forwards, face to face with the neck of a tube, onto which it is pushed with centering by the ram with axis 35. The orientation of the cap is determined at the beginning of the guiding path by an internal rib 38 on the outside of the intermediate ring 17 (FIG. 1), and is then maintained. This first inserting action typically corresponds to the insertion of the cutting fins round the portion for guiding the neck of the tube, without any cutting proper.

The tubes 1 carry a mark 39 which can be detected by optical means, always in the same position relative to the background of their skirt. Each tube 1 is charged in the "6 o'clock" position, then orientated by turning it on itself and stopped in the "4 o'clock" position by means of a photoelectric detector 40. It is fitted with a cap 3 in the "12 o'clock" position, then the cap is pushed into the neck of the tube until it snaps on (ram with axis 41) in the "9 o'clock" position, and the tube is then discharged.

The cap according to the invention makes it possible to obtain a series of decorated tubes with caps which have a constant, definitive position relative thereto, with an accuracy of ±1° to 3°, for example using an installation of the type described above.

We claim:

1. A unit made up of a cap (3) and a receptacle (1) with a neck (2) made of plastics, the cap (3) comprising a base (4) or stub (4) made of plastics and an opening part (5) which can seal the base (4), wherein the base (4) includes a sealing means (16) inside the neck (2) and can be fixed on the neck (2) simply by pushing and snapping it on, wherein:

a) the base (4) and neck (2) comprise means for relative immobilisation in rotation (18 and 9) by longitudinal insertion; and wherein b) a mating longitudinal insertion means (18 and 9) and a mating snapping on means (19, 13 and 15) on the base (4) and neck (2) respectively, and the sealing means on the base (4), are configured whereby when the base (4) is pushed onto the neck (2):
insertion with a full cross-section of the insertion means is initiated;
then forced insertion of the sealing means (16) in the neck (2) is initiated; and
then a snapping-on action is initiated.

2. The unit of claim 1, wherein the longitudinal insertion means (18) carried by the cap base (4) comprise radial cutting fins (18) with a tapering edge (21) which are 0.1 to 0.3 mm thick, wherein the neck (2) has an anti-rotation locking portion (9) with an external diameter larger than the internal diameter between tapering edges (21) of the cap base (4), and wherein the base (4) is made of a plastics material harder than the plastics material of the neck (2).

3. The unit of claim 2, wherein the radial fins (18) are carried by the inside of an axial ring (17) inside the cap base (4), and wherein the snap-on means (19) of the cap (4) is also carried by the ring (17) below the fins (18).

4. The unit of claim 2 or 3, wherein the cap base (4) and the neck (2) comply with the following two conditions:

the difference in level (D1) of the cap base (4), between the end of the widened part of the bottom of its cutting fins (18) and the beginning (22) of the forced insertion portion of its sealing means (16) is greater than the difference in level (d1) of the neck, between the top of its orifice (6) and the beginning of its anti-rotation locking portion (9);

the difference in level (D2) of said cap base (4), between the minimum diameter of its snap-on means (19) and the beginning (22) of the forced insertion portion of its sealing means (16) is less than the difference in level (d2) of the neck (2), between the top of its orifice (6) and the maximum diameter (14) of its snap-on means (13 and 15), corresponding to the snap-on means (18) of the cap base (4).

5. The unit of claim 2 or 3, wherein the anti-rotation locking portion (9) of the neck (2) is preceded by a cylindrical guiding portion (8), with an external diameter less than 0.5 mm smaller than said internal diameter between tapering edges (18) of the cap base (4).

6. The unit of any of claims 1 to 3, wherein the snap-on means (19) of the cap base (4) and neck (2) are a spring ring (19) and an annular throat (15) with mating profiles, the profiles comprising in axial section an upper or entry surface inclined at 15° to 35° to the axis, and a lower or abutment surface inclined at 40° to 60° to the axis (11).

7. The unit of claim 2 or 3, wherein the radial cutting fins (18) have an edge (21) which tapers at a total angle of 10° to 15° to the axis, in perpendicular section.

8. The unit of claim 5, wherein the anti-rotation locking portion (9) of the neck (2) comprises a chamfered upper end (10), which facilitates the initiation of cutting by the radial fins (18) of the cap base (4).

9. Method of assembly of the unit of any of claims 1 to 3, wherein, with the receptacle (1) carried by a positioning means (39), firstly the receptacle (1) is oriented using an external positioning device (40) cooperating with said positioning means (39), and secondly the cap (3) is oriented relative to the receptacle (1), then fixed onto the neck (2) of the receptacle (1) by its base or stub (4) by pushing and snapping it on, thereby obtaining a cap (3) in a fixed position with a selected orientation.

10. The unit of claim 4 wherein the snap-on means (19) of the cap base (4) and neck (2) are a spring ring (19) and an annular throat (15) with mating profiles, the profiles comprising an axial section an upper or entry surface inclined at 15° to 30° to the axis, and a lower or abutment surface inclined at 40° to 60° to the axis (11).

11. The unit of claim 5 wherein the snap-on means (19) of the cap base (4) and neck (2) are a spring ring (19) and an annular throat (15) with mating profiles, the profiles comprising in axial section an upper or entry surface inclined at 15° to 30° to the axis, and a lower or abutment surface inclined at 40° to 60° to the axis (11).

* * * * *